US010718532B2

(12) United States Patent
Guarino et al.

(10) Patent No.: US 10,718,532 B2
(45) Date of Patent: Jul. 21, 2020

(54) FAN COIL HOUSING

(71) Applicants: Robert Guarino, Toronto (CA); Riffe Nazarian, Markham (CA)

(72) Inventors: Robert Guarino, Toronto (CA); Riffe Nazarian, Markham (CA)

(73) Assignee: Premier Coil Systems Inc., Mississauga (CA)

( * ) Notice: Subject to any disclaimer, the term of this patent is extended or adjusted under 35 U.S.C. 154(b) by 61 days.

(21) Appl. No.: 16/181,505

(22) Filed: Nov. 6, 2018

(65) Prior Publication Data

US 2019/0137117 A1 May 9, 2019

Related U.S. Application Data

(60) Provisional application No. 62/581,866, filed on Nov. 6, 2017.

(51) Int. Cl.

| | |
|---|---|
| ***F24H 3/06*** | (2006.01) |
| ***F28F 13/12*** | (2006.01) |
| ***F24F 1/0011*** | (2019.01) |
| ***F24F 1/0022*** | (2019.01) |
| ***F24F 13/20*** | (2006.01) |

(52) U.S. Cl.

CPC ..... *F24F 1/0011* (2013.01); *F24F 1/0022* (2013.01); *F24F 13/20* (2013.01); *F24F 2013/205* (2013.01)

(58) Field of Classification Search

CPC ..... F24F 1/0011; F24F 1/0022; F24F 13/20; F24F 2013/205

USPC ..... 165/122

See application file for complete search history.

(56) References Cited

U.S. PATENT DOCUMENTS 4,776,180 A * 10/1988 Patton, Sr. ..... F24D 17/02 237/2 B 2006/0042207 A1 3/2006 Jenkins et al.

2017/0343222 A1* 11/2017 Markert ..... F24F 1/0011

* cited by examiner

*Primary Examiner* — Davis D Hwu

(74) *Attorney, Agent, or Firm* — Young Basile Hanlon & MacFarlane, P.C.

(57) ABSTRACT

An apparatus for use with a fan coil cabinet occluded by a releasably secured baffle having intake and discharge vents communicating with the cabinet and containing a coil which water passes and a fan which forces air past the coil for conditioning, wherein the fan has an outlet and a coil. The apparatus comprises a housing with the fan and coil mounted thereto, and a support mounted to the cabinet wherein the housing slides for movement between a retracted position, within the cabinet, and an extended position, protruding from the cabinet. The housing has a port with the fan coupled thereto for sealed communication between the port and the outlet. The coil and the housing define a cavity with which the port communicates. The housing defines an aperture and a door releasably secured in occluding relation to the aperture to provide access to the cavity for maintenance of the coil.

8 Claims, 4 Drawing Sheets

FAN COIL HOUSING

CROSS-REFERENCE TO RELATED APPLICATIONS

This application is a nonprovisional of U.S. Provisional Patent Application Ser. No. 62/581,866, filed Nov. 6, 2017.

FIELD OF THE INVENTION

The invention relates to HVAC.

BACKGROUND

In multi-unit dwellings, it is known for each unit to include a coil and a fan. In the winter, warm fluid is produced in a central boiler and delivered to the coil, such that air can be forced past the coil and heated. In the summer, cold fluid is produced in a central chiller and delivered to the coil, such that air can be forced past the coil and cooled. It is commonplace for the coil and fan to be mounted in a cabinet.

SUMMARY

Forming one aspect of the invention is an apparatus for use with a vertical fan coil cabinet of the type which has a pair of parallel side panels, a bottom portion, and a top portion, and in use, is occluded by a releasably secured baffle having an intake vent communicating with the bottom portion and a discharge vent communicating with the upper portion, and in use, contains a coil through which water is passed and a fan which forces air past the coil for conditioning, the fan having an outlet and a coil.

This apparatus comprises a housing to which, in use, the fan and the coil are mounted, and a support, which in use, is mounted to the cabinet and to which the housing is slidably mounted for movement of the housing between a retracted position, within an interior of the cabinet, and an extended position, protruding from the cabinet.

According to another aspect of the invention, the housing can have a port, and the fan can be coupled in use to the port for sealed communication between the port and the outlet.

According to another aspect of the invention, in use, the coil and the housing can define a cavity with which the port communicates.

According to another aspect of the invention, the housing can define an aperture and can have a door adapted to be releasably secured in occluding relation to the aperture, and the aperture being sized and positioned such that, in use, when the housing is in the extended position, the aperture provides access to the cavity for maintenance of the coil.

Forming another aspect of the invention is an apparatus for use with a vertical fan coil cabinet of the type which has a pair of parallel side panels, a bottom portion, and a top portion, and in use, is occluded by a releasably secured baffle having an intake vent communicating with the bottom portion and a discharge vent communicating with the upper portion, and in use, contains a coil through which water is passed and a fan which forces air past the coil for conditioning.

This apparatus comprises a fan having an outlet, a coil, a housing to which, in use, the fan and the coil are mounted, and a support which, in use, is mounted to the cabinet and to which the housing is slidably mounted for movement of the housing between a retracted position, interior of the cabinet and an extended position, protruding from the cabinet.

According to another aspect, the housing can have a port, and the fan can be coupled to the port for sealed communication between the port and the outlet.

According to another aspect, the coil and the housing can define a cavity with which the port communicates.

According to another aspect, the housing can define an aperture and can have a door adapted to be releasably secured in occluding relation to the aperture, and the aperture being sized and positioned such that, in use, when the housing is in the extended position, the aperture provides access to the cavity for maintenance of the coil.

Other advantages, features and characteristics of the invention will become apparent upon a review of the following detailed description with reference to the appended drawings, the latter being briefly described hereinafter.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Figure 1:
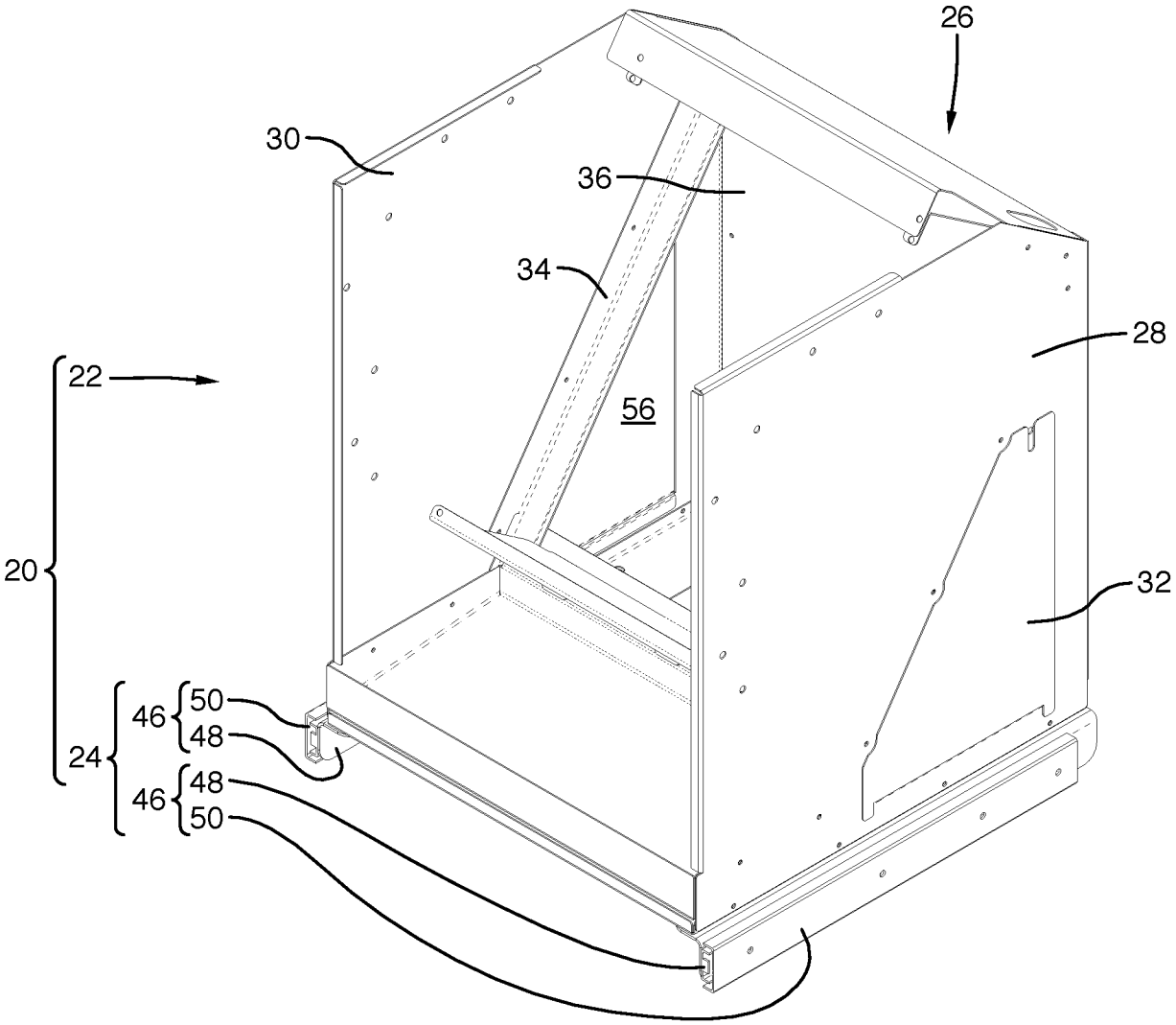
FIG. 1 is a perspective view of the apparatus according to an exemplary embodiment of the invention.

Apparatus 20 according to an exemplary embodiment of the invention is shown in FIG.1 and will be seen to comprise a housing 22 and a support 24.

Figure 2:
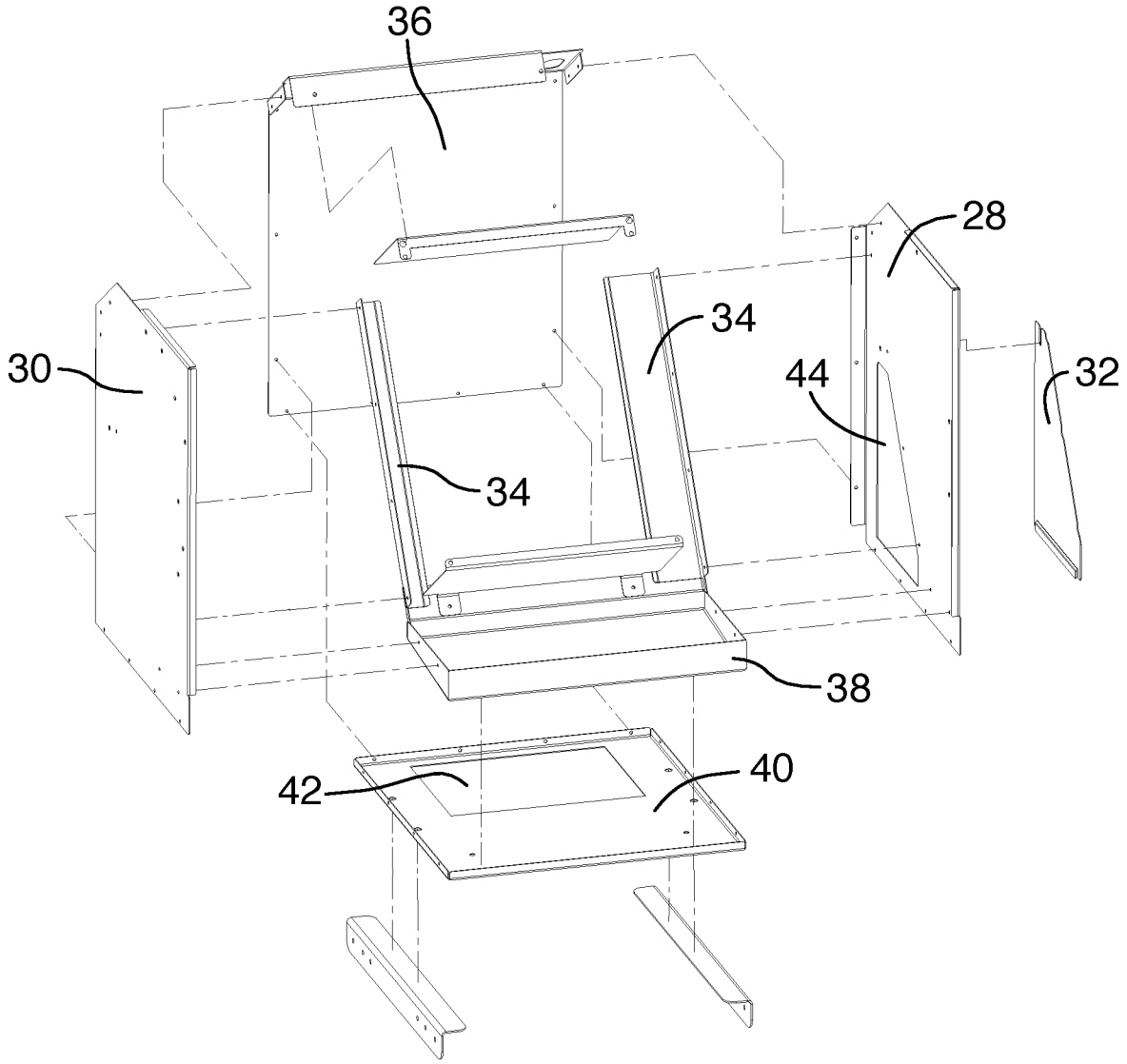
FIG. 2 is an exploded view of the structure of FIG. 1.

With reference to FIG. 1 and also with reference to the exploded view in FIG. 2, the housing 22 will be seen to have a main assembly 26, a pair of sides 28, 30, a door 32, and a pair of braces 34.

The main assembly 26 includes: a back 36; a condensate tray 38 disposed in spaced relation to the back 36; and a base 40 which extends from the back 36 to support the condensate tray 38 and defines a port 42 intermediate the back 36 and the condensate tray 38.

The pair of sides 28, 30 flank the main assembly: one of the sides 28 has an aperture 44 defined therein.

The door 32 is releasably secured to and occludes the aperture 44.

The pair of braces 34 extends from the condensate tray to the back 36 and in angular relation to the back 36.

The support 24 will be seen to be defined by a pair of slides 46, each having an extension 48 fixedly secured to the base 40, and a mount 50 slidably mounted to the extension 48.

Figure 3:
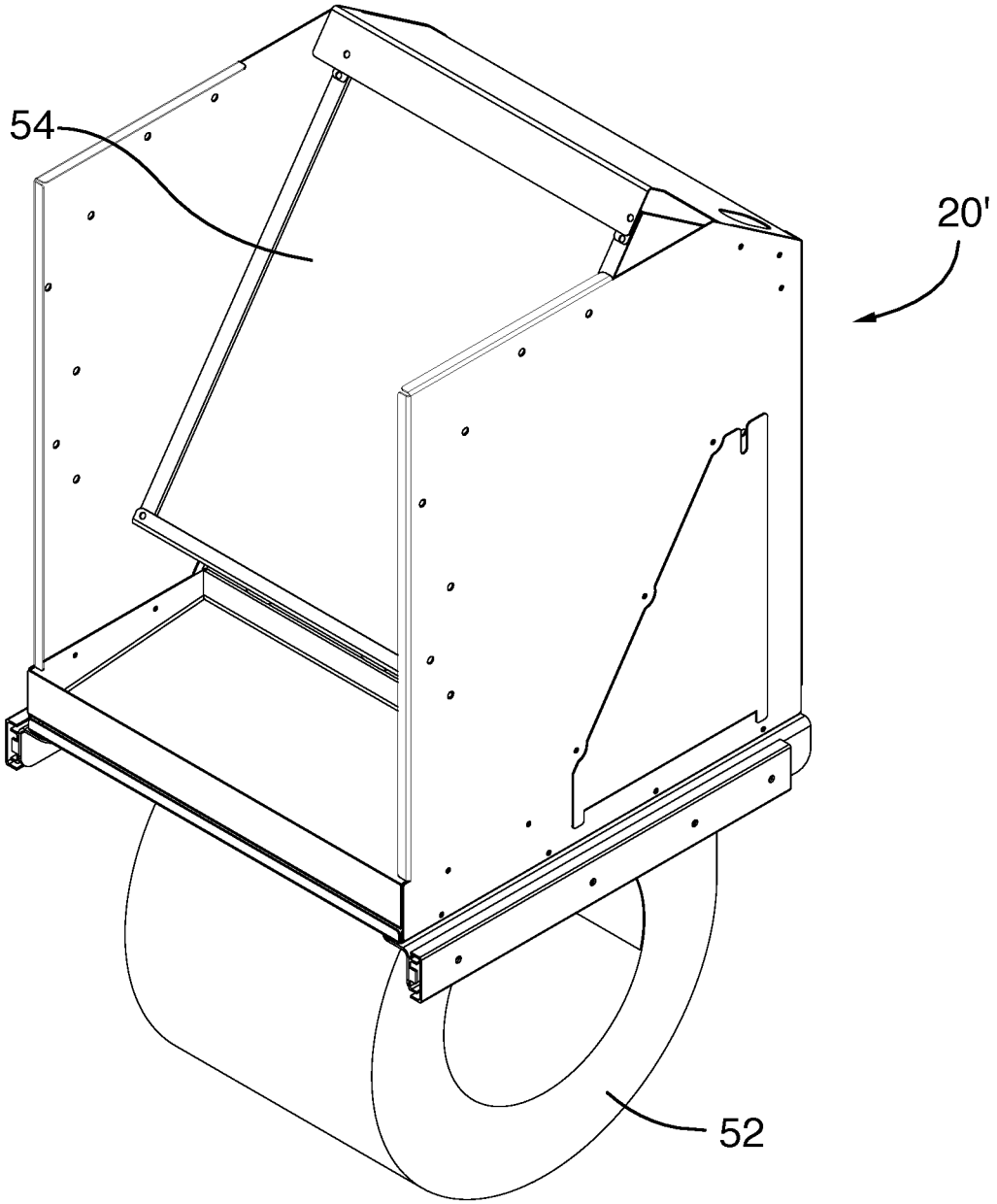
FIG. 3 is a perspective view of the apparatus according to another exemplary embodiment of the invention, in a retracted position.

The apparatus of FIG. 1 is used, as indicated in FIG. 3, with a fan 52 having an outlet (not shown) and a coil 54. In this assembly 20', which will be understood to form another exemplary embodiment of the invention, the fan 52 is mounted beneath the base 40, and the outlet of the fan is coupled to the port 42 for sealed communication between the port and the outlet, and the coil 54 and the housing 22 define a cavity with which the port 42 communicates and to which the aperture 44 leads, the location of the cavity being indicated by reference numeral 56 in FIG. 1.

Although not shown, it should be understood that the apparatus of FIG. 3 is used with a vertical fan coil cabinet of the type which has a pair of parallel side panels, a bottom portion, and a top portion, and in use, is occluded by a releasably secured baffle having an intake vent communicating with the bottom portion and a discharge vent communicating with the upper portion, and in use, contains a coil through which water is passed and a fan which forces air past the coil for conditioning.

Figure 4:
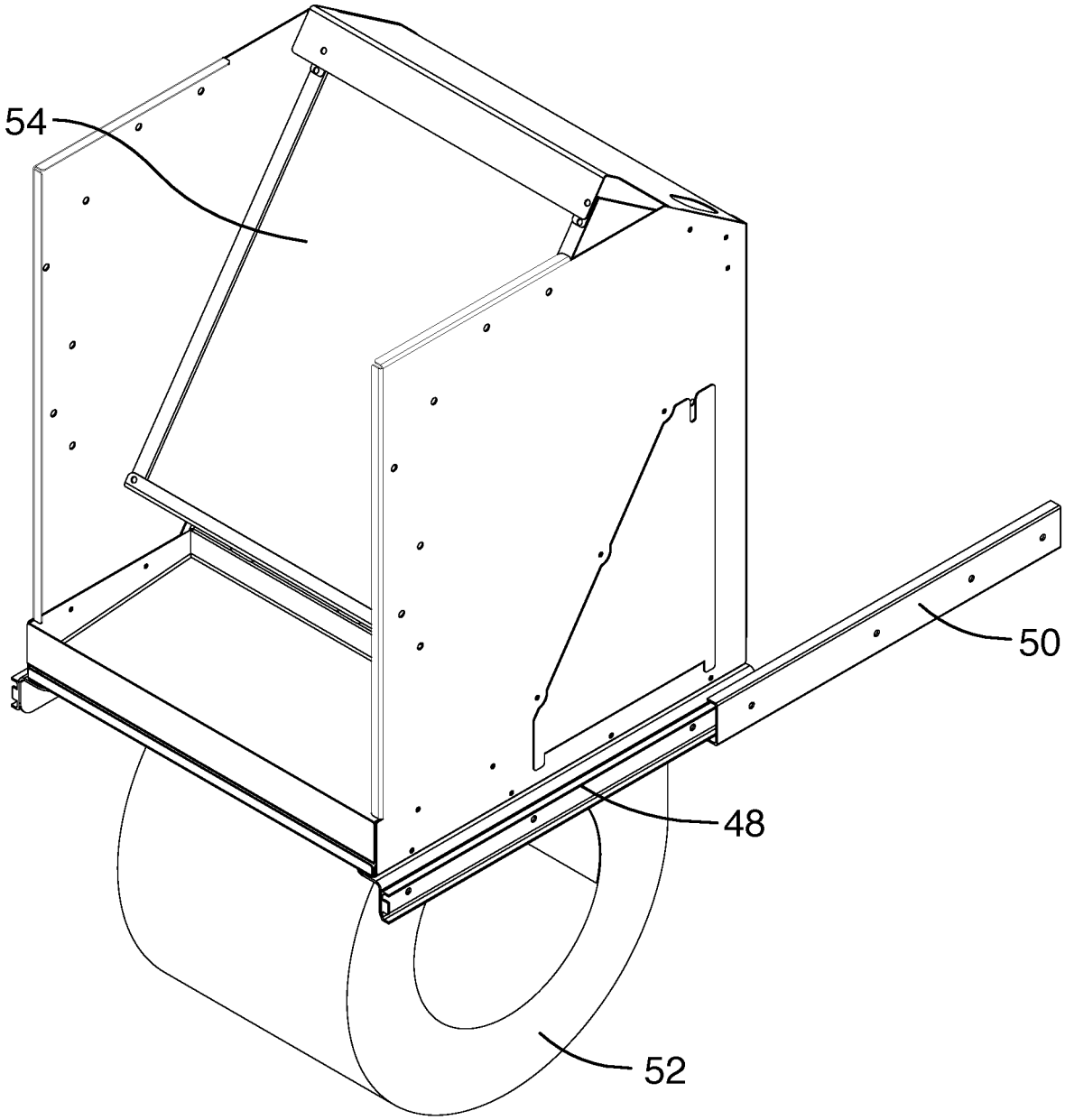
FIG. 4 is a view of the apparatus of FIG. 3 in an extended position.

In such use, the mounts 50 are fixed to the side panels of the cabinet such that the housing 22 is slidably mounted for movement between a retracted position [shown in FIG. 3], interior of the cabinet, and an extended position [shown in FIG. 4] protruding from the cabinet; and when the housing is in the extended position, and the door is removed (not shown), the aperture provides access to the cavity for maintenance of the coil.

Whereas two specific embodiments are herein shown and described, variations are of course possible.

For example, only:

the housing can be varied in size to accommodate cabinets of any dimension; and fans and coils of many manufacturers and of varied type can be used.

Accordingly, the invention should be understood to be limited only by the accompanying claims, purposively construed.

As used herein, the terminology "or" is intended to mean an inclusive "or" rather than an exclusive "or". That is, unless specified otherwise, or clear from context, "X includes A or B" is intended to indicate any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form.

Further, for simplicity of explanation, although the figures and descriptions herein may include sequences or series of steps or stages, elements of the methods disclosed herein may occur in various orders or concurrently. Additionally, elements of the methods disclosed herein may occur with other elements not explicitly presented and described herein. Furthermore, not all elements of the methods described herein may be required to implement a method in accordance with this disclosure. Although aspects, features, and elements are described herein in particular combinations, each aspect, feature, or element may be used independently or in various combinations with or without other aspects, features, and elements.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

The invention claimed is:

1. An apparatus for use with a vertical fan coil cabinet of the type which has a pair of parallel side panels, a bottom portion, and a top portion, and in use, is occluded by a releasably secured baffle having an intake vent communicating with the bottom portion and a discharge vent communicating with the upper portion, and in use, contains a coil through which water is passed and a fan which forces air past the coil for conditioning, a fan having an outlet and a coil, the apparatus comprising:

a housing to which, in use, the fan and the coil are mounted; and a support which, in use, is mounted to the cabinet, and to which the housing is slidably mounted, for movement of the housing, in use, between a retracted position, interior of the cabinet; and an extended position, protruding from the cabinet.

2. The apparatus according to claim 1, wherein the housing has a port, and the fan is coupled in use to the port for sealed communication between the port and the outlet.

3. The apparatus according to claim 2, wherein, in use, the coil and the housing define a cavity with which the port communicates.

4. The apparatus according to claim 3, wherein the housing defines an aperture and has a door adapted to be releasably secured in occluding relation to the aperture, the aperture being sized and positioned such that, in use, when the housing is in the extended position, the aperture provides access to the cavity for maintenance of the coil.

5. An apparatus for use with a vertical fan coil cabinet of the type which has a pair of parallel side panels, a bottom portion, and a top portion, and in use, is occluded by a releasably secured baffle having an intake vent communicating with the bottom portion and a discharge vent communicating with the upper portion, and in use, contains a coil through which water is passed and a fan which forces air past the coil for conditioning, the apparatus comprising:

a fan having an outlet;

a coil;

a housing to which, in use, the fan and the coil are mounted; and a support which, in use, is mounted to the cabinet and to which the housing is slidably mounted, for movement of the housing, in use, between a retracted position, interior of the cabinet and an extended position, protruding from the cabinet.

6. The apparatus according to claim 5, wherein the housing has a port, and the fan is coupled to the port for sealed communication between the port and the outlet.

7. The apparatus according to claim 6, wherein the coil and the housing define a cavity with which the port communicates.

8. The apparatus according to claim 7, wherein the housing defines an aperture and has a door adapted to be releasably secured in occluding relation to the aperture, the aperture being sized and positioned such that, in use, when the housing is in the extended position, the aperture provides access to the cavity for maintenance of the coil.

* * * * *